United States Patent [19]

Matsuda

[11] Patent Number: 4,709,562

[45] Date of Patent: Dec. 1, 1987

[54] WARP-KNIT SUPPORT TAPE FOR HOOK AND LOOP FASTENERS

[75] Inventor: Yoshio Matsuda, Toyama, Japan

[73] Assignee: Yoshida Kogyo K. K., Tokyo, Japan

[21] Appl. No.: 922,166

[22] Filed: Oct. 23, 1986

[30] Foreign Application Priority Data

Oct. 23, 1985 [JP] Japan ..... 60-162742[U]

[51] Int. Cl.[4] ..... D04B 7/12

[52] U.S. Cl. ..... 66/193; 24/445; 24/452; 66/194

[58] Field of Search ..... 66/190–195; 24/452, 445

[56] References Cited

U.S. PATENT DOCUMENTS

| | | | |
|---|---|---|---|
| 2,435,897 | 2/1948 | Newman | 66/193 |
| 3,109,302 | 11/1963 | Vitek | 66/191 X |
| 3,845,641 | 11/1974 | Waller | 66/193 |
| 4,338,800 | 7/1982 | Matsuda | 66/196 X |
| 4,467,625 | 8/1984 | Kurz | 66/193 |

FOREIGN PATENT DOCUMENTS

| | | | |
|---|---|---|---|
| 1189336 | 6/1985 | Canada | 66/194 |
| 57-381 | 1/1982 | Japan . | |

*Primary Examiner*—Ronald Feldbaum

*Attorney, Agent, or Firm*—Hill, Van Santen, Steadman & Simpson

[57] ABSTRACT

A warp-knit support tape for hook and loop fasteners comprises a foundation including two needle stitches and laid-in weft threads, and a pile portion having chain stitches formed by sinker looping into a multiplicity of pile-loops. The tape system is rendered highly resistant to stretch in either direction. The pile-loops are arranged to line up alternately at the right and at the left of the wales and tilted sidewise alternately in opposite directions.

5 Claims, 12 Drawing Figures

WARP-KNIT SUPPORT TAPE FOR HOOK AND LOOP FASTENERS

BACKGROUND OF THE INVENTION

1. Field of the Invention

This invention relates to a hook and loop fastener otherwise known as a velvet clasp fastener comprising two layers of fabric which are releasably engageable with each other. One of the fabric layers carries hook-shaped or male elements engageable with loop or female elements on the other fabric layer. The present invention is more specifically concerned with such hook and loop fasteners which comprise a warp-knit support tape carrying thereon a multiplicity of pile-loop elements and engageable with its mating hook-carrying tape.

2. Description of the Prior Art

A typical hook and loop fastener having a warp-knit support tape structure is known, as for example disclosed in Japanese Patent Publication No. 57-381, in which threads are formed into pile-loops by lateral lapping over every other wale on the tape, the pile-loops being anchored in place with their leg portions knitted into chain stitches of a foundation web.

Such prior art fastener has a drawback in that due to pile-loops being formed by lapping over every other wale, the interstices of the web in between the pile and the foundation become coarse and weak so that the pile is prone to shift out of position and to get sometimes pulled off.

SUMMARY OF THE INVENTION

It is therefore the primary object of the present invention to provide a hook and loop fastener which will eliminate the foregoing drawbacks of the prior art and which has a warp-knit support tape carrying thereon pile-loops or female elements securely held in place apainst displacement or dislocation.

It is another object of the invention to provide a hook and loop fastener in which the pile-loops are arranged to provide increased opportunity of engagement with hook elements on the mating support tape.

These and other objects and features of the invention will be better understood from the following detailed description taken with reference to the accompanying drawings.

DETAILED DESCRIPTION

Figure 1:
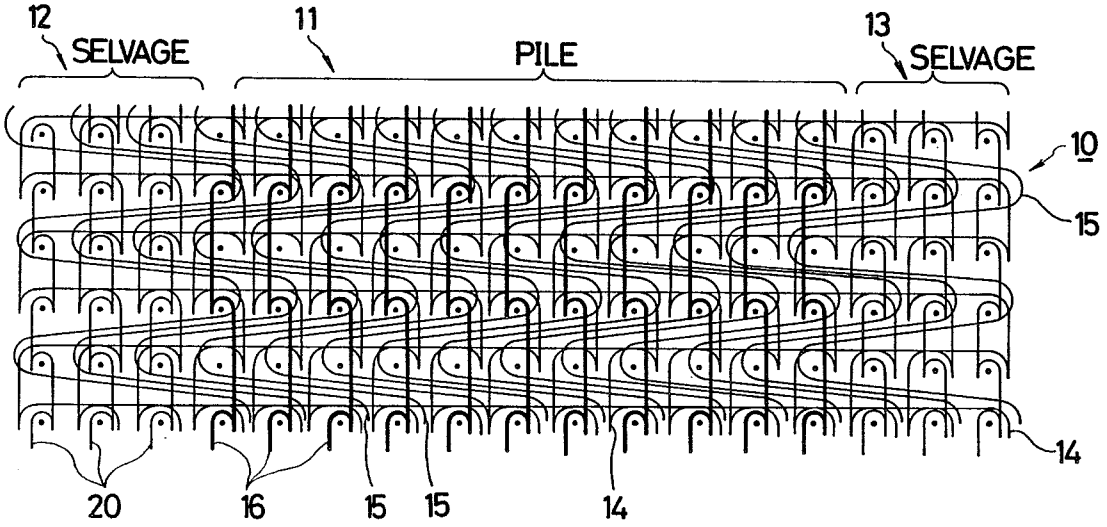
FIG. 1 schematically illustrates the construction of a warp-knit support tape embodying the invention for use as a loop part of a hook and loop fastener.
Figure 2A:
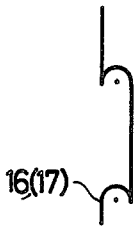
FIGS. 2*a*–2*d*, inclusive, each are schematic diagrams of stitches constituting the warp-knit tape of FIG. 1.
Figure 2B:
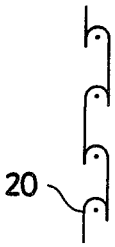

Referring now to the drawings and FIG. 1 in particular, there is shown a preferred form of a warp-knit support tape 10 to be used as a loop or female part of a hook and loop fastener. The support tape 10 consists of a pile portion 11 and selvage portions 12 and 13 extending warpwise on opposite sides of the pile portion 11. The pile portion 11 of the tape 10 is constructed with two needle stitches 14, laid-in weft threads 15, both of which are laced together to make up a foundation of the tape 10, and chain stitches 16 which form a multiplicity of pile-loops 17. (FIG. 3) As shown in FIG. 2*a*, the chain stitch 16 is of an open lap having a Link No. 1-0/0-0/0-1/1-1, and threads therefor are positively overfed about 1.5 times the normal rate of feed of threads for the remaining stitches and formed by sinker looping into pile-loops 17 extending over every other course in overlapping relation to the knitting needles. The pile-loops 17 are arranged to extend longitudinally of the tape 10 alternately along the right and left sides of wales 18 as shown in FIG. 3, and also to tilt sidewise alternately in opposite direction as shown in FIG. 4, the arrangement being such that the pile-loops 17 give themselves more opportunity to engage the hooks on the mating tape, not shown, than would be otherwise possible.

In the embodiment shown in FIG. 1 and as better shown in FIG. 2*a*, the pile-loops 17 extend over every other course. They may of course be modified to extend over every two or three, or even at each course as shown in FIG. 5, depending upon the size of starting threads, the density of knit fabric, or the combination with companion hooks.

Figure 2C:
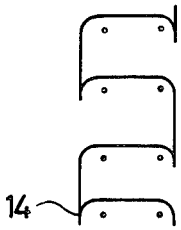
Figure 2D:
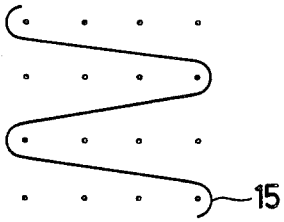

The foundation of the support tape 10 is formed by two needle stitches 14 of Link No. 0-2/2-0/0-2/2-0 as shown in FIG. 2*c* and laid-in weft threads 15 of Link No. 0-0/4-4/0-0/4-4. As shown in FIG. 3, the sinker loops 14*a*, 14*b* of two needle stitches 14 are arranged to urge and hold the leg portions 17*a* of pile-loops 17 criss-cross against the foundation web of the tape 10, while the laid-in weft threads 15 fill up in between the sinker loops 14*a*, 14*b* and the pile-loops 17, thus anchoring the pile-loops 17 stably in place against displacement or dislocation.

Figure 3:
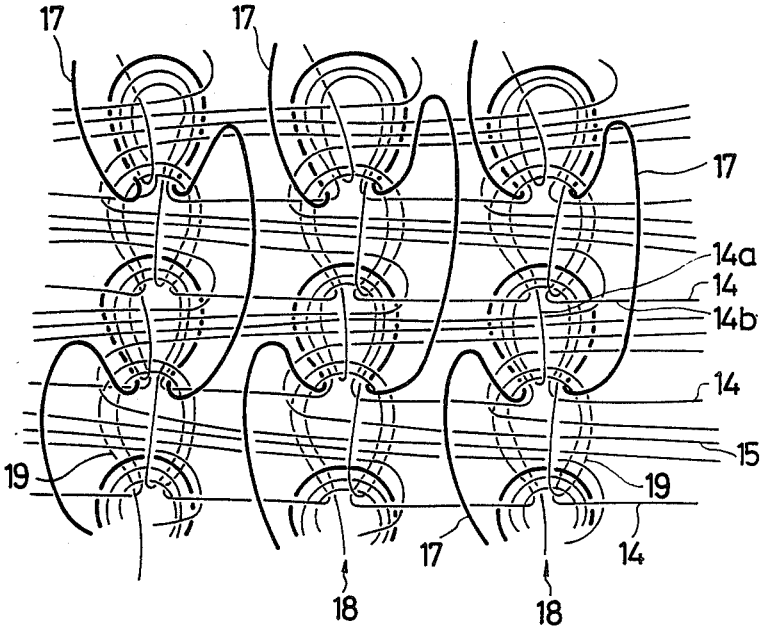
FIG. 3 is a schematic representation on enlarged scale of a portion of the tape of FIG. 1.
Figure 4:
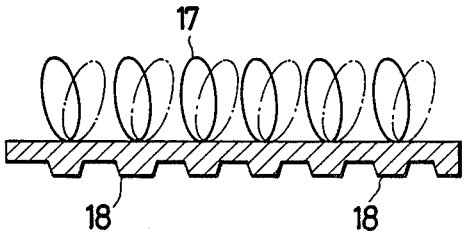
FIG. 4 is a schematic side elevation showing the pile-loops of the tape of FIG. 1.
Figure 5A:
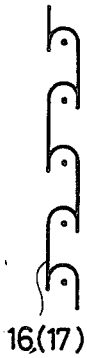
FIGS. 5*a*–5*d*, inclusive, each are schematic diagrams of stitches constituting another form of warp-knit tape embodying the invention.
Figure 5B:
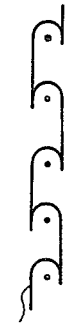
Figure 5C:
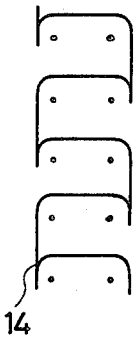
Figure 5D:
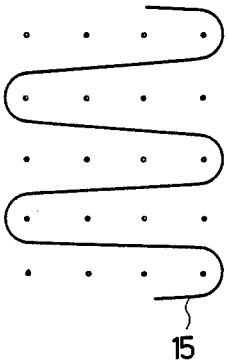
Figure 6:
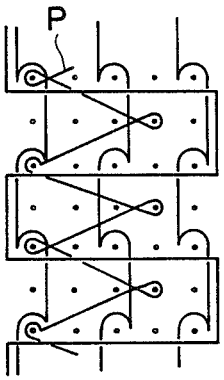
FIG. 6 PRIOR ART
FIG. 6 schematically shows the construction of a prior art warp-knit tape for a hook and loop fastener.

As better shown in FIG. 3, the sinker loops 14*a*, 14*b* of two needle stitches 14 are laced in a manner to bear against the foundation loops 19 that form the wales 18, and the weft threads 15 that are laid in densely between the foundation loops 19, and the sinker loops 14*a*, 14*b* are held in place by the latter loops, whereby the tape system as a whole is rendered highly resistant to stretch in either direction. This arrangement will in turn reduce the amount of resinous coatings reguired to make the knit tape firm and prevent the pile-loops from falling off, and further serves to provide a tape product which is physically soft.

The selvages 12 and 13 extend over three wales on opposite sides of the tape 10 as shown in FIG. 1 and are constructed with the two needle stitches 14, laid-in weft threads 15 and chain stitches 20 of an open lap having Link No. 1-0/0-1/1-0/0-1. The tape 10 is sewn or otherwise attached along the selvages 12 and 13 onto a garment article.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A warp-knit support tape for hook and loop fasteners which comprises a pile portion constructed with two needle stitches, laid-in weft threads and chain stitches formed by sinker looping into pile-loops, said pile-loops extending longitudinally of the tape alternately along the right and left sides of wales.

2. A warp-knit support tape according to claim 1 wherein said pile-loops are tilted sidewise alternately in opposite directions.

3. A warp-knit support tape according to claim 1 wherein said pile-loops extend over every other course.

4. A warp-knit support tape according tyo claim 1 wherein said pile-loops extend along each course.

5. A warp-knit support tape according to claim 1 wherein said two needle stitches have their sinker loops arranged to hold said pile-loops criss-cross against the foundation of the tape.

* * * * *